US008952850B2

(12) United States Patent
Park et al.

(10) Patent No.: US 8,952,850 B2
(45) Date of Patent: Feb. 10, 2015

(54) MIMO ANTENNA APPARATUS

(75) Inventors: Sung Won Park, Suwon-si (KR); Yeon Joo Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 429 days.

(21) Appl. No.: 13/373,564

(22) Filed: Nov. 18, 2011

(65) Prior Publication Data

US 2012/0127056 A1 May 24, 2012

(30) Foreign Application Priority Data

Nov. 24, 2010 (KR) ..... 10-2010-0117467

(51) Int. Cl.

| | |
|---|---|
| ***H01Q 1/38*** | (2006.01) |
| ***H01Q 1/52*** | (2006.01) |
| ***H01Q 9/42*** | (2006.01) |
| ***H01Q 21/28*** | (2006.01) |

(52) U.S. Cl.

CPC ..... *H01Q 1/521* (2013.01); *H01Q 9/42* (2013.01); *H01Q 21/28* (2013.01)

USPC ..... 343/700 MS; 343/702; 343/893; 343/853

(58) Field of Classification Search

USPC ..... 343/700 MS, 702

See application file for complete search history.

(56) References Cited

U.S. PATENT DOCUMENTS 7,411,554 B2 * 8/2008 Jung et al. ..... 343/700 MS
2011/0298669 A1 * 12/2011 Rao et al. ..... 343/702

* cited by examiner

*Primary Examiner* — Dieu H Duong

(57) ABSTRACT

A MIMO antenna apparatus is provided. The MIMO antenna apparatus includes a plurality of antenna devices each having an operation line extending parallel by a predetermined extension length from one end portion and configured to operate in a resonant frequency band when power is supplied. The apparatus also includes a main board divided into a device area and aground area. The apparatus further includes a plurality of ground pads each extending from the ground plate to the device area in the main board and configured to connect the one end portion of each of the antenna devices to the ground plate. The apparatus also includes a plurality of feeding pads mounted adjacent to the ground pad in the device area and configured to connect each of the antenna devices to the main board and to provide power to each of the antenna devices.

20 Claims, 16 Drawing Sheets

MIMO ANTENNA APPARATUS

CROSS-REFERENCE TO RELATED APPLICATION(S) AND CLAIM OF PRIORITY

The present application is related to and claims the benefit under 35 U.S.C. §119 a of a Korean patent application filed in the Korean Intellectual Property Office on Nov. 24, 2010 and assigned Serial No. 10-2010-0117467, and the entire disclosure of which is hereby incorporated by reference.

TECHNICAL FIELD OF THE INVENTION

The present invention relates to an antenna apparatus, and more particularly, to a multiple-input multiple-output (MIMO) antenna apparatus having a plurality of antenna devices.

BACKGROUND OF THE INVENTION

In general, in a wireless communication system, various multimedia services such as video, music, and game playing are provided. In order to smoothly provide a multimedia service, a high speed data transmission rate for an enormous amount of multimedia data should be ensured. Thus, research for improving performance of an antenna apparatus in a communication terminal has been performed. This is because in a communication terminal, an antenna apparatus substantially transmits and receives data for a multimedia service. At the present, in a wireless communication system, as an antenna apparatus mounted in a communication terminal, a MIMO antenna apparatus is suggested. The MIMO antenna apparatus includes a plurality of antenna devices. In such a MIMO antenna apparatus, by transmitting and receiving a signal in a predetermined frequency band through antenna devices, data can be transmitted in a high speed.

However, when operating such a MIMO antenna apparatus, electromagnetic coupling occurs between antenna devices. This is because when decreasing a size of a MIMO antenna apparatus in order to decrease a size of a communication terminal, a performance of a wireless communication system is deteriorated. Therefore, a method of suppressing electromagnetic coupling between antenna devices in the MIMO antenna apparatus is needed.

SUMMARY OF THE INVENTION

To address the above-discussed deficiencies of the prior art, it is a primary object to provide a MIMO antenna apparatus that can suppress electromagnetic coupling between antenna devices.

In accordance with an aspect of the present invention, a MIMO antenna apparatus is provided. The MIMO antenna apparatus includes a plurality of antenna devices each having an operation line extending parallel by a predetermined extension length from one end portion and configured to operate in a resonant frequency band when power is supplied. The apparatus also includes a main board divided into a device area in which the antenna devices are adjacently disposed and a ground area in which a ground plate configured to ground the antenna devices is mounted. The apparatus further includes a plurality of ground pads each extending from the ground plate to the device area in the main board, configured to connect the one end portion of each of the antenna devices to the ground plate, and separated by a predetermined distance. The apparatus still further includes a plurality of feeding pads mounted adjacent to the ground pad in the device area and configured to connect each of the antenna devices to the main board by electrically connecting to the main board and to provide power to each of the antenna devices.

The present invention provides a MIMO antenna apparatus that can decrease a size of a communication terminal by decreasing a size of a MIMO antenna apparatus.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

For a more complete understanding of the present disclosure and its advantages, reference is now made to the following description taken in conjunction with the accompanying drawings, in which like reference numerals represent like parts.

Throughout the drawings, it should be noted that like reference numbers are used to depict the same or similar elements, features, and structures.

DETAILED DESCRIPTION OF THE INVENTION

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged antenna apparatus. The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but are merely used by the inventor to enable a clear and consistent understanding of the invention. Accordingly, it should be apparent to those skilled in the art that the following description of exemplary embodiments of the present invention is provided for illustration purposes only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
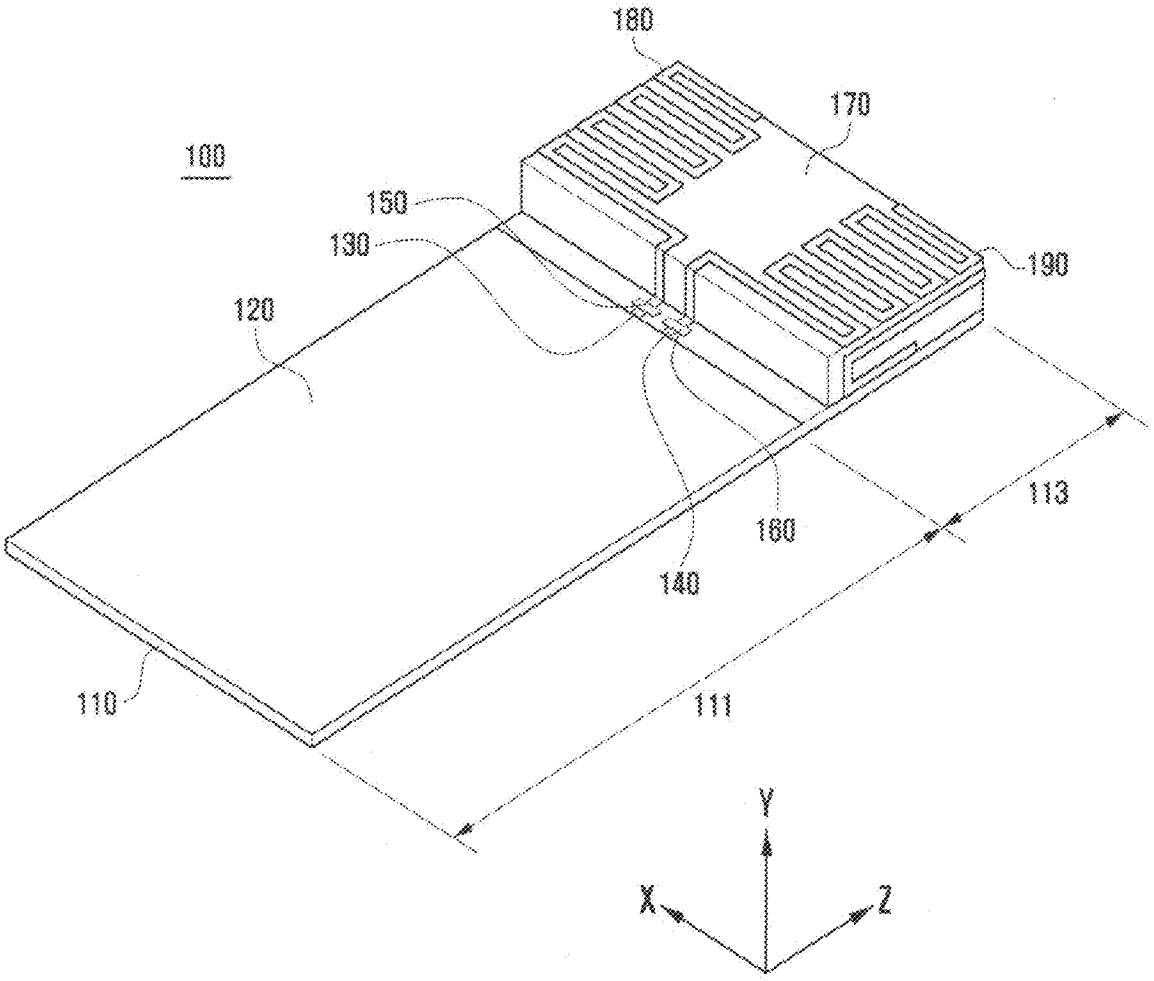
FIG. 1 illustrates in one direction a structure of a MIMO antenna apparatus according to an embodiment of the present invention.
Figure 2:
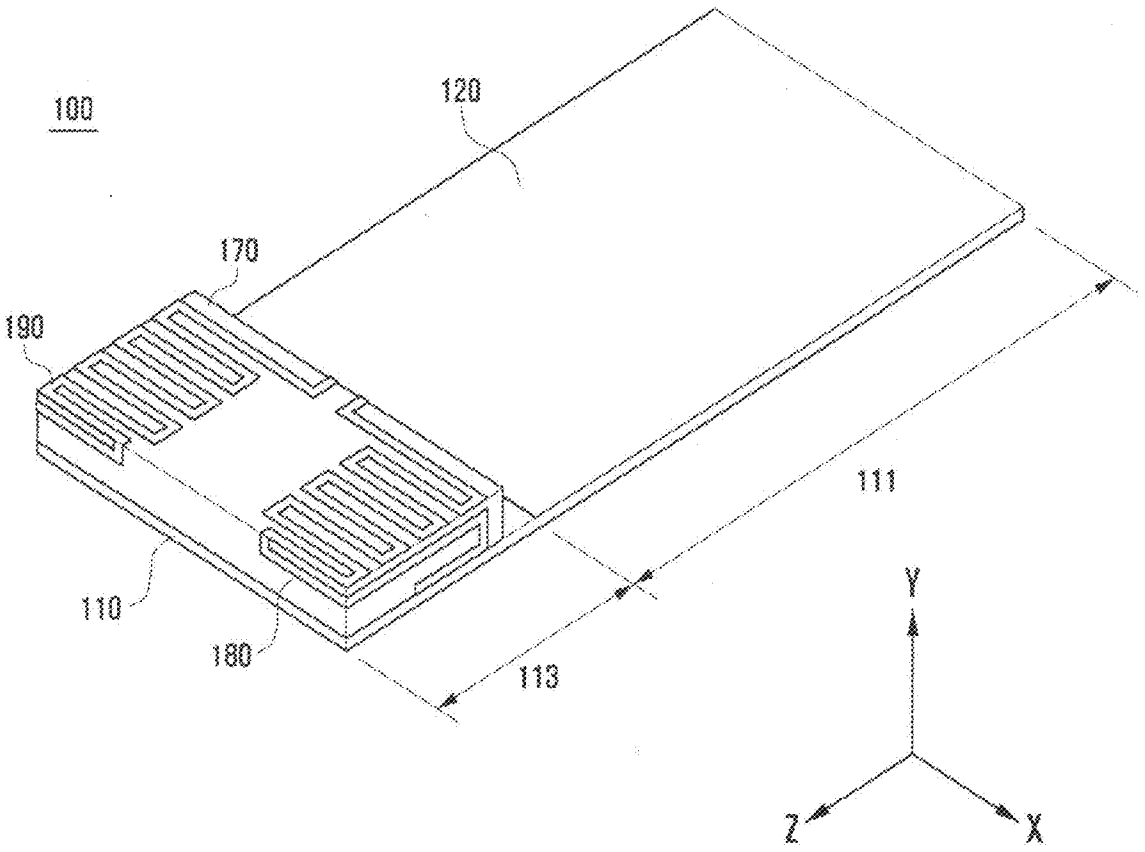
FIG. 2 illustrates in another direction a structure of a MIMO antenna apparatus according to an embodiment of the present invention.
Figure 3:
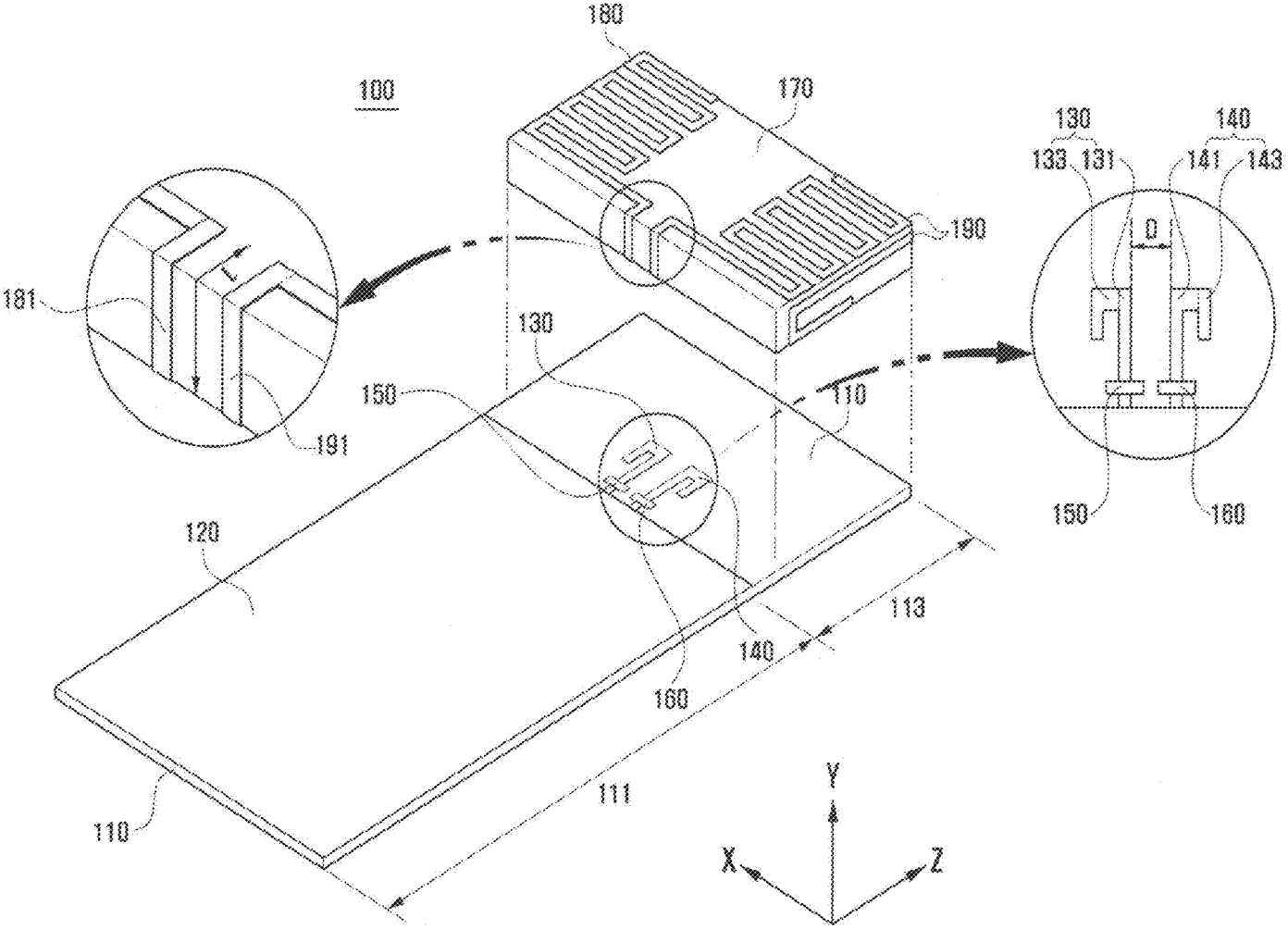
FIG. 3 illustrates a configuration of a MIMO antenna apparatus according to an embodiment of the present invention.

FIG. 1 is a perspective view illustrating in one direction a structure of a MIMO antenna apparatus according to an embodiment of the present invention. FIG. 2 is a perspective view illustrating in another direction a structure of a MIMO antenna apparatus according to an embodiment of the present invention. FIG. 3 is an exploded perspective view illustrating a configuration of a MIMO antenna apparatus according to an embodiment of the present invention. In the present embodiment, the MIMO antenna apparatus is formed as a printed circuit board (PCB).

Referring to FIGS. 1, 2, and 3, a MIMO antenna apparatus 100 according to the present embodiment includes a main board 110, ground plate 120, pad devices 130 and 140, matching devices 150 and 160, antenna carrier 170, and antenna devices 180 and 190.

The main board 110 is provided to support the MIMO antenna apparatus 100 and supply power in the MIMO antenna apparatus 100. The main board 110 is formed in a flat plate structure. One surface of the main board 110, an upper surface of a Y-axis direction, is divided into a ground area 111 and a device area 113. Further, the main board 110 is formed with a dielectric body having a plurality of feeding lines (not shown). Here, the main board 110 is formed by stacking a plurality of dielectric plates in a Y-axis direction. Each feeding line is exposed to the outside through both end portions. Here, one end portion of the feeding line is connected to an external power source (not shown). Another end portion of the feeding line is exposed to the outside through the device area 113. Thereby, when power is supplied from an external power source through one end portion, the feeding line supplies power to the other end portion. Here, power can be limitedly supplied to at least one of feeding lines.

The ground plate 120 is provided to ground in the MIMO antenna apparatus 100. The ground plate 120 is disposed at the ground area 111 of the main board 110. The ground plate 120 includes a flat plate structure. Here, the ground plate 120 is disposed horizontally to one surface of the main board 110, for example in an X-axis direction and a Z-axis direction in order to cover an entire area of the ground area 111. Alternatively, the ground plate 120 is disposed vertically to one surface of the main board 110, for example in a Y-axis direction in a partial area of the ground area 111. The ground plate 120 may be formed in a flat plate structure having a groove or a hole of various forms.

The pad devices 130 and 140 are provided for electrical connection in the MIMO antenna apparatus 100. That is, the pad devices 130 and 140 are used for supplying power to the antenna devices 180 and 190 and for grounding the antenna devices 180 and 190. The pad devices 130 and 140 are separately disposed in the device area 113 of the main board 110. The pad devices 130 and 140 are mounted at a surface of the main board 110 and are disposed at the device area 113. The pad devices 130 and 140 are made of a metal material. Here, the pad devices 130 and 140 are formed in a patch type and are attached to the device area 113. Alternatively, the pad devices 130 and 140 may be formed in a transmission line type and be patterned in the device area 113. Further, the pad devices 130 and 140 are formed with ground pads 131 and 141 and feeding pads 133 and 143, respectively. In the pad devices 130 and 140, the ground pads 131 and 141 and the feeding pads 133 and 143 are physically coupled.

Each of the ground pads 131 and 141 contacts with the ground plate 120 through one end portion and is disposed at the device area 113 of the main board 110. Each of the ground pads 131 and 141 is extended from the ground plate 120 to the device area 113 through the other end portion, for example in at least one of an X-axis direction and a Z-axis direction. The ground pads 131 and 141 are separated by a predetermined separation distance D. The ground pads 131 and 141 sustain a gap by the separation distance D. Here, the separation distance may be more than 0 mm and less than or equal to 7 mm. Further, each of the ground pads 131 and 141 is formed in at least one of a bar type, meander type, spiral type, step type, and loop type.

Each of the feeding pads 133 and 143 is electrically connected to a feeding line of the main board 110 through one end portion and is disposed at the device area 113 of the main board 110. Each of the feeding pads 133 and 143 is extended from the feeding line of the main board 110 to the device area 113 through the other end portion, for example in at least one of an X-axis direction and a Z-axis direction. The feeding pads 133 and 143 are disposed adjacent to the ground pads 131 and 141, respectively. Further, the feeding pads 133 and 143 are coupled to the ground pads 131 and 141, respectively, through the other end portion. The feeding pads 133 and 143 are disposed opposite to the ground pads 131 and 141, respectively. That is, the ground pads 131 and 141 are disposed between the feeding pads 133 and 143. Here, the feeding pads 133 and 143 are extended parallel to the ground pads 131 and 141, respectively. In addition, each of the feeding pads 133 and 143 is formed in at least one of a bar type, meander type, spiral type, step type, and loop type.

The matching devices 150 and 160 are provided for electrical matching in the MIMO antenna apparatus 100. That is, the matching devices 150 and 160 support electrical matching for the antenna devices 180 and 190, respectively. The matching devices 150 and 160 are separately mounted in the device area 113 of the main board 110. The matching devices 150 and 160 are mounted on a surface of the main board 110 and are disposed at the device area 113. The matching devices 150 and 160 are electrically connected to the ground pads 131 and 141 of the pad devices 130 and 140, respectively. Thereby, the matching devices 150 and 160 are connected to the ground plate 120 through the ground pads 131 and 141, respectively.

Further, the matching devices 150 and 160 each have matching inductance. Here, the matching inductance may be between 2 nH and 7 nH. In addition, the matching devices 150 and 160 are formed with electronic elements and mounted on the ground pads 131 and 141, respectively.

The antenna carrier 170 is provided as an intermediary in the MIMO antenna apparatus 100. The antenna carrier 170 is mounted in the device area 113 of the main board 110. The antenna carrier 170 is formed in a flat plate structure having an area formed by a thickness of one direction, for example a Y-axis direction and vertically to one direction, for example an X-axis and a Z-axis. Here, the antenna carrier 170 is formed in a shape corresponding to the device area 113 and is formed in a shape protruded from the device area 113. The antenna carrier 170 exposes the matching devices 150 and 160 in the device area 113. Further, the antenna carrier 170 is formed with a dielectric material. Here; the antenna carrier 170 may have the same characteristic as that of the main board 110 or may have a characteristic different from that of the main board 110.

The antenna devices 180 and 190 are provided to transmit and receive a signal in the MIMO antenna apparatus 100. That is, the antenna devices 180 and 190 perform a function of transmitting and receiving electromagnetic waves by resonating in at least one resonant frequency band. The antenna devices 180 and 190 are adjacently separated in the device area 113 of the main board 110. Here, the antenna devices 180 and 190 may be formed in a symmetrical shape or may be formed in an asymmetrical shape.

The antenna devices 180 and 190 contact with the pad devices 130 and 140 and are electrically connected to the pad devices 130 and 140, respectively, through one end portion. The antenna devices 180 and 190 are connected to the ground plate 120 through the ground pads 131 and 141 of the pad devices 130 and 140, respectively. The antenna devices 180 and 190 are connected to a feeding line of the main board 110 through the feeding pads 133 and 143 of the pad devices 130 and 140. Further, the antenna devices 180 and 190 are extended from the pad devices 130 and 140 to the device area 113 through the other end portion, for example in at least one of an X-axis direction and a Z-axis direction. In addition, the antenna devices 180 and 190 are formed in a transmission line type of a metal material and are disposed at the device area 113. The antenna devices 180 and 190 are extended parallel by a predetermined extension distance from each one end portion. That is, the antenna devices 180 and 190 are extended parallel from one end portion and include operation lines 181 and 191, respectively, having a predetermined extension length L. Here, an extension length may be between 5 mm and 30 mm.

The antenna devices 180 and 190 may be patterned on a surface of the device area 113 or may be patterned on a surface of the antenna carrier 170. Thereby, the antenna devices 180 and 190 are separately disposed from the main board 110 and the ground plate 120, respectively, by a distance corresponding to a thickness or an area of the antenna carrier 170. Each of the antenna devices 180 and 190 is formed in a structure having at least one bent portion. Here, each of the antenna devices 180 and 190 is formed in at least one of a meander type, spiral type, step type, and loop type.

Thereby, when power is applied from an external power source through the feeding pads 133 and 143 of the pad devices 130 and 140, the antenna devices 180 and 190 resonate in a resonant frequency band. Here, as power is limitedly applied to a portion of the feeding pads 133 and 143, a portion of the antenna devices 180 and 190 resonates in a resonant frequency band. The antenna devices 180 and 190 are grounded to the ground plate 120 through the ground pads 131 and 141 of the pad devices 130 and 140, respectively. A signal is radiated from each of the antenna devices 180 and 190 to air. Here, a radiation signal of one of the antenna devices 180 and 190 is transmitted into the remaining one of the antenna devices 180 and 190 via air. Further, a radiation signal of one of the antenna devices 180 and 190 is transmitted into the remaining one of the antenna devices 180 and 190 via the ground plate 120 in air.

In the pad devices 130 and 140 for each of the antenna devices 180 and 190, the ground pads 131 and 141 are separately disposed by a predetermined separation distance, and in the antenna devices 180 and 190, the ground pads 131 and 141 are extended parallel by a predetermined extension distance from the pad devices 130 and 140. Thereby, an amplitude of a radiation signal transmitted into air from the antenna devices 180 and 190 and an amplitude of a radiation signal transmitted via the ground plate 120 are identical. The antenna devices 180 and 190 are connected to the matching devices 150 and 160, respectively, having each matching inductance. Thereby, a phase of a radiation signal transmitted into air from the antenna devices 180 and 190 and a phase of a radiation signal transmitted via the ground plate 120 have a difference of a half-wavelength, i.e., 180°.

Accordingly, a radiation signal transmitted into air from the antenna devices 180 and 190 and a radiation signal transmitted via the ground plate 120 are canceled. That is, a radiation signal of one of the antenna devices 180 and 190 is suppressed from operating as an interference signal of the remaining one of the antenna devices 180 and 190. Thereby, electromagnetic coupling between the antenna devices 180 and 190 is suppressed.

Further, in the MIMO antenna apparatus 100 according to the present embodiment, the pad devices 130 and 140 and the antenna devices 180 and 190 are designed to have different device inductances and device capacitances in order to perform a function thereof. That is, the pad devices 130 and 140 and the antenna devices 180 and 190 are formed to have device inductance, device capacitance, and device resistance for resonating in at least one resonant frequency band. An electrical characteristic such as device inductance, device capacitance, and device resistance is determined according to a structure, shape, and material of each of the pad devices 130 and 140 and the antenna devices 180 and 190. Here, the pad devices 130 and 140 and the antenna devices 180 and 190 are divided into horizontal component lines extended in a direction horizontal to the ground plate 120, for example in an X-axis direction and vertical component lines extended in a direction vertical to the ground plate 120, for example in a Z-axis direction.

That is, device inductance is determined according to an area, for example a total length and width of horizontal component lines and vertical component lines, of the pad devices 130 and 140 and the antenna devices 180 and 190. Device capacitance is determined according to a length of the ground plate 120 and the horizontal component lines in the pad devices 130 and 140 and the antenna devices 180 and 190. Device resistance is determined according to loss by radiation and loss by a material of the pad devices 130 and 140 and the antenna devices 180 and 190 i.e., loss by a metal material constituting the pad devices 130 and 140 and the antenna devices 180.

Accordingly, the MIMO antenna apparatus 100 according to the present embodiment has a more improved operation characteristic. This is described with reference to FIGS. 4A through 6B.

FIGS. 4A through 6B are graphs illustrating an operation characteristic of a MIMO antenna apparatus according to an embodiment of the present invention.

Figure 4A:
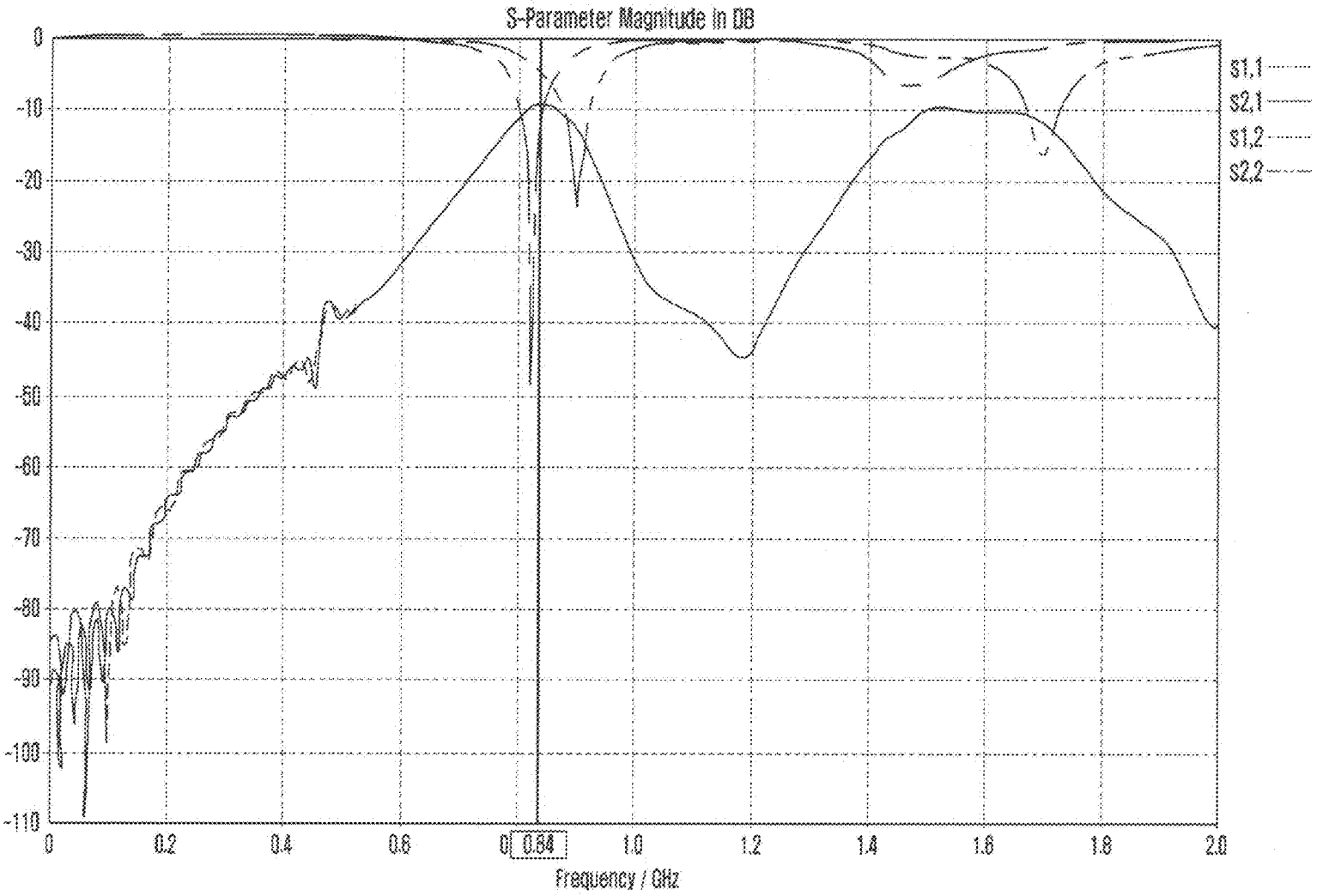
FIGS. 4A through 6B illustrate an operation characteristic of a MIMO antenna apparatus according to an embodiment of the present invention.
Figure 4B:
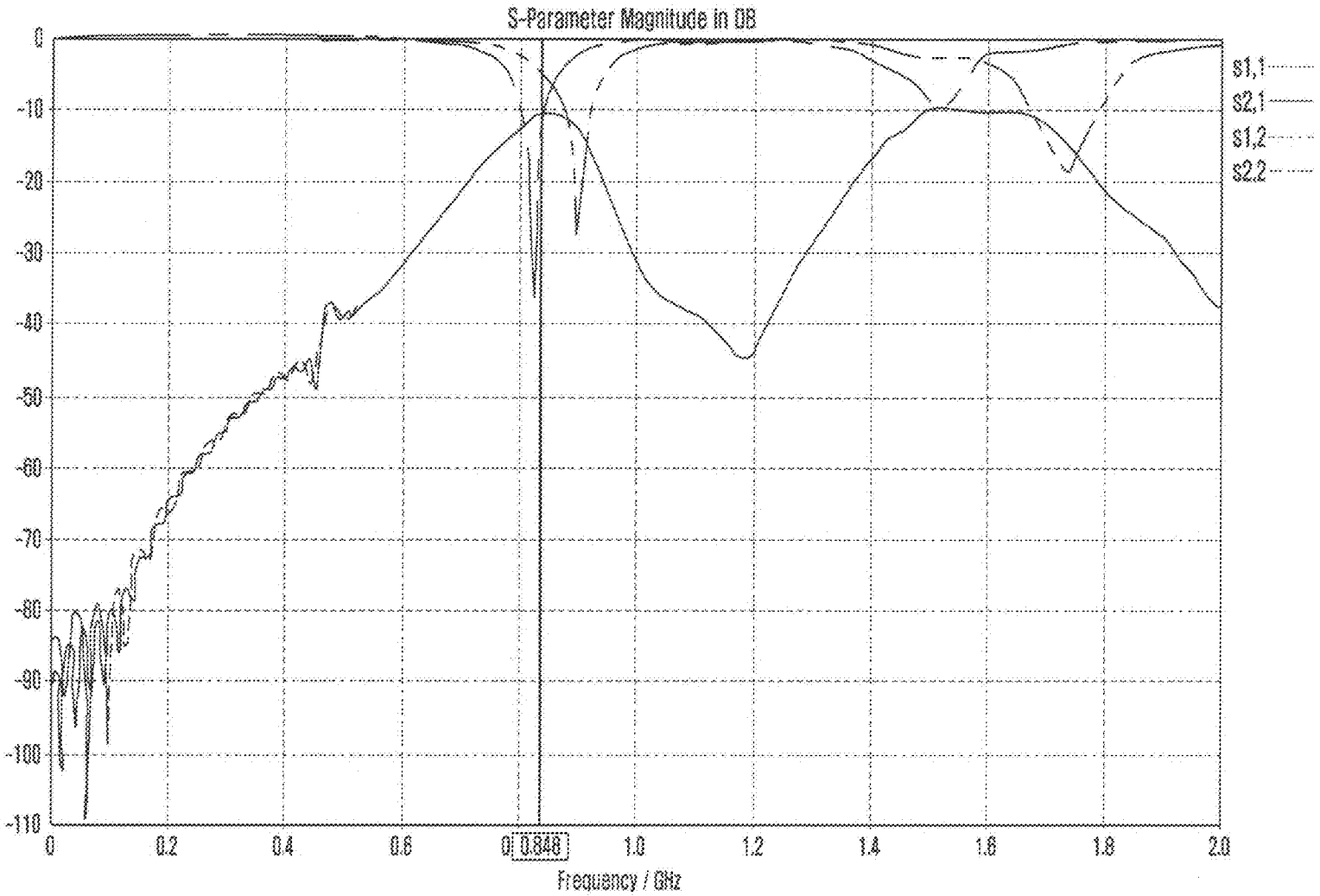
Figure 4C:
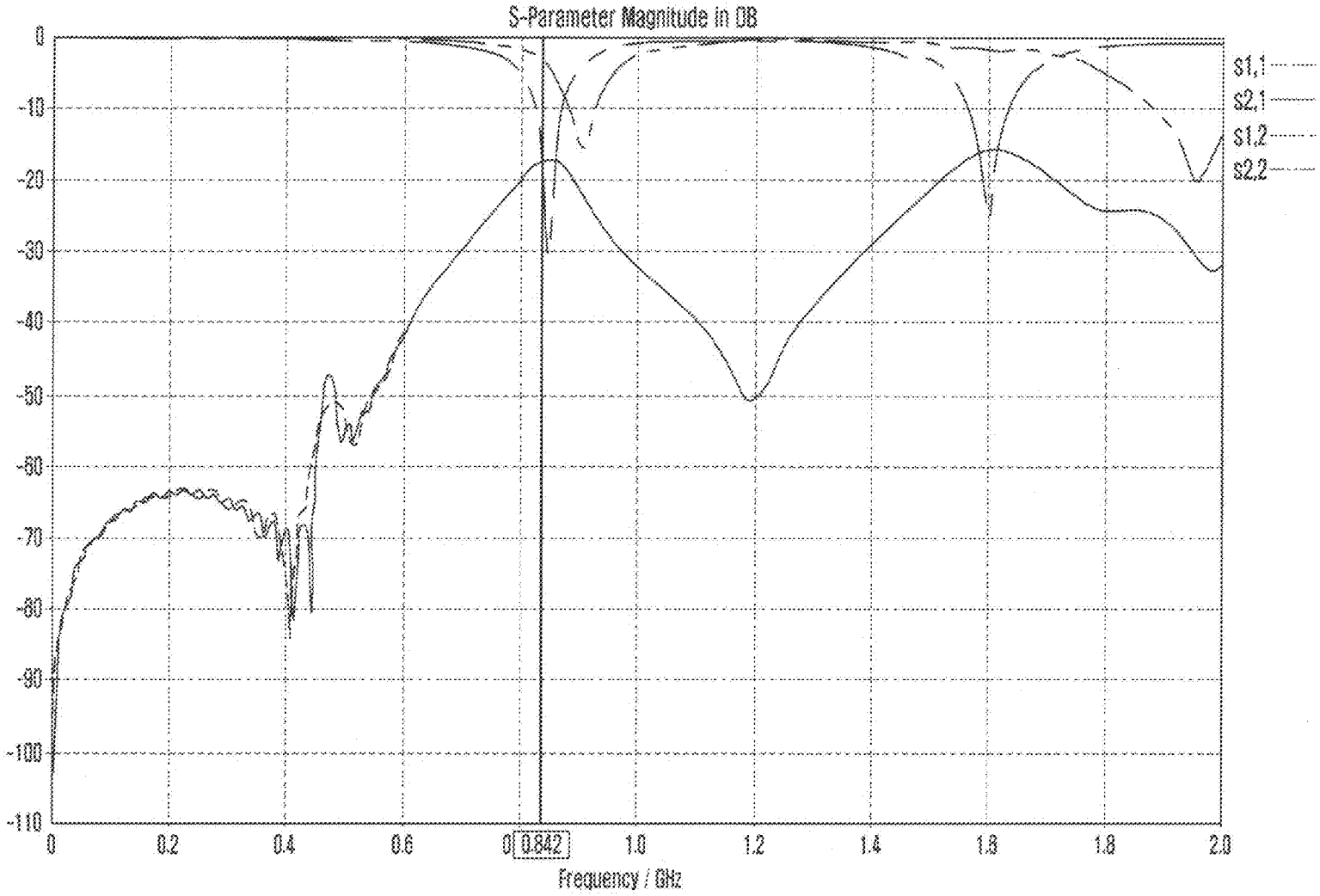
Figure 4D:
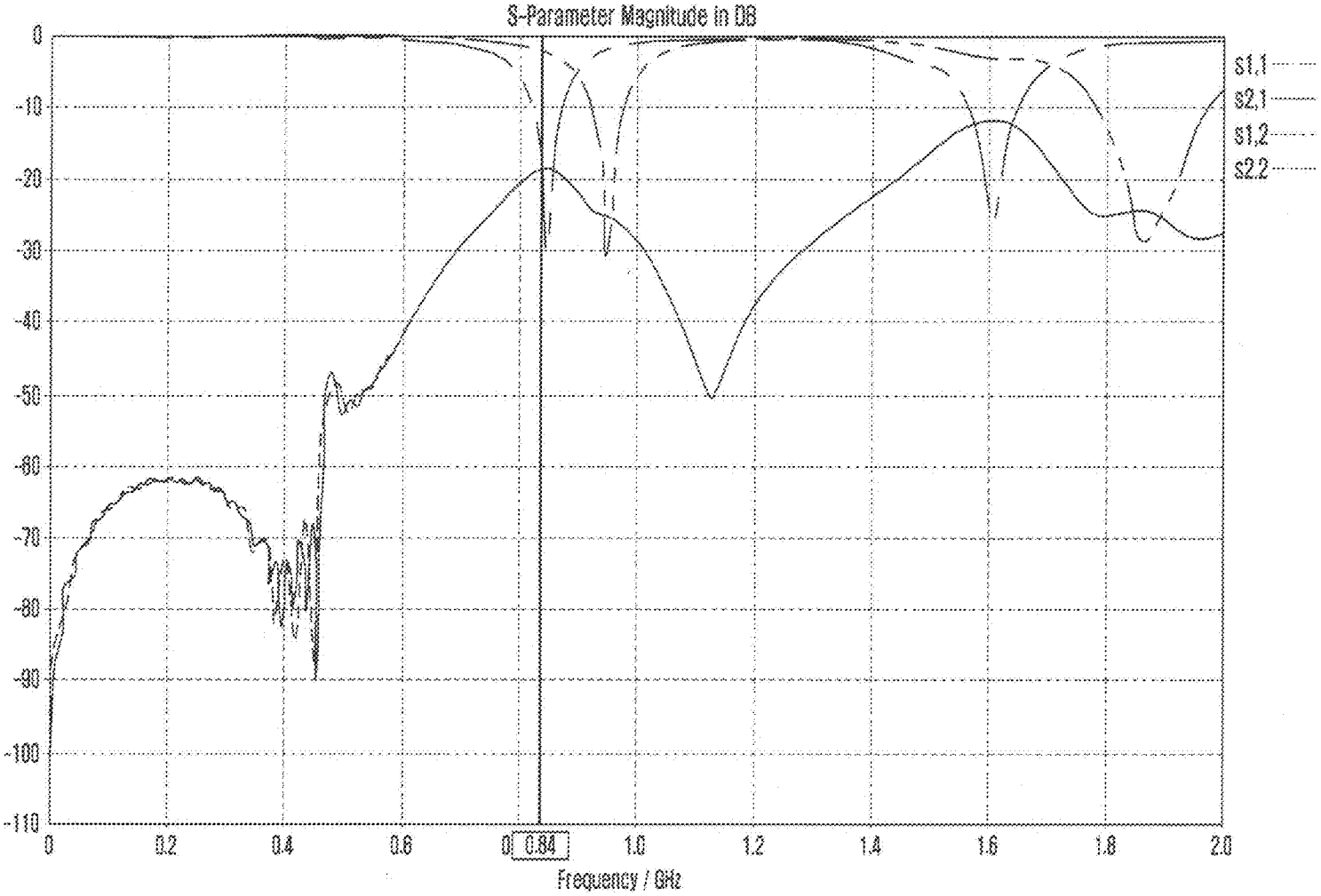

FIGS. 4A through 4D are graphs illustrating a change of a parameter S according to a separation distance between ground pads in a MIMO antenna apparatus. FIG. 4A illustrates an embodiment where a separation distance is 13 mm, FIG. 4B illustrates an embodiment where a separation distance is 11 mm, FIG. 4C illustrates an embodiment where a separation distance is 7 mm, and FIG. 4D illustrates an embodiment where a separation distance is 4 mm. Here, the MIMO antenna apparatus has a resonant frequency band of 0.84 GHz.

Referring to FIGS. 4A through 4D, in the MIMO antenna apparatus, when each antenna device operates, as a separation distance between ground pads decreases, $S_{1,2}$ and $S_{2,1}$ increase in a resonant frequency band. That is, in the MIMO antenna apparatus, when a separation distance is 13 mm, in a resonant frequency band, $S_{1,2}$ and $S_{2,1}$ are about −9.5 dB. In the MIMO antenna apparatus, when a separation distance is 11 mm, in the resonant frequency band, $S_{1,2}$ and $S_{2,1}$ are about −12 dB. Further, in the MIMO antenna apparatus, when a separation distance is 7 mm, in the resonant frequency band, $S_{1,2}$ and $S_{2,1}$ are about −15.5 dB. In addition, in the MIMO antenna apparatus, when a separation distance is 4 mm, in the resonant frequency band, $S_{1,2}$ and $S_{2,1}$ are about −15.5 dB. In other words, in the MIMO antenna apparatus, as the ground pads are disposed closer together, electromagnetic coupling of the antenna devices is suppressed or reduced. Therefore, in the MIMO antenna apparatus according to the present embodiment, an operation characteristic is improved.

Figure 5A:
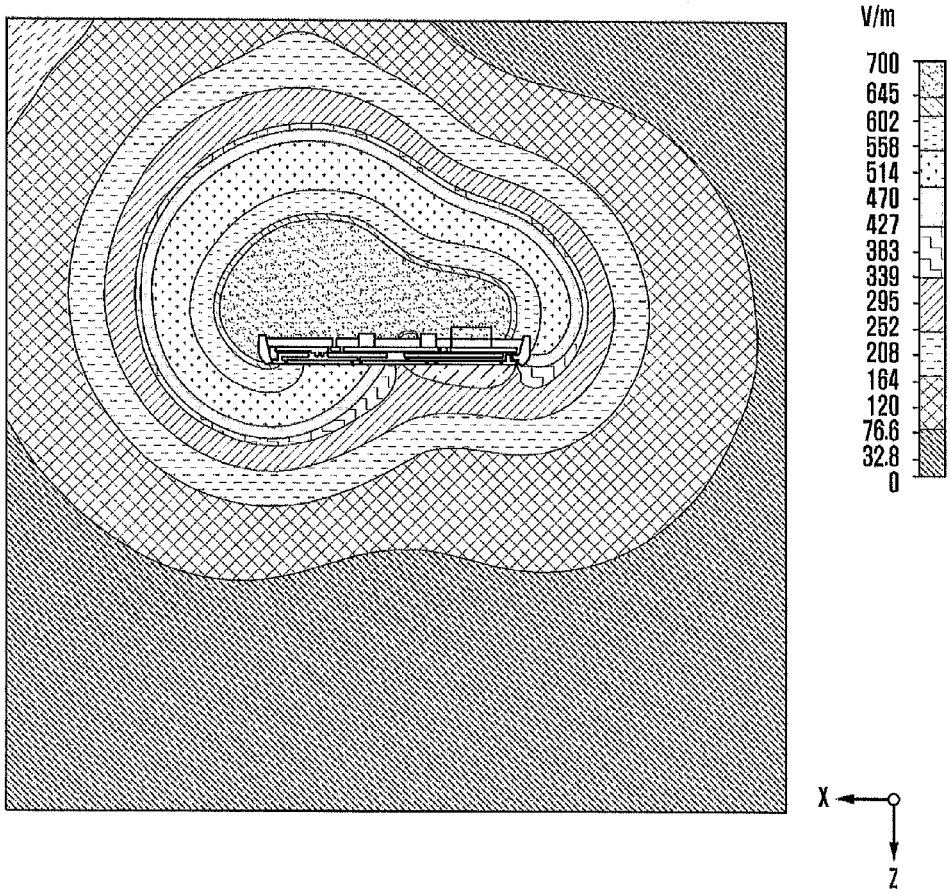
Figure 5B:
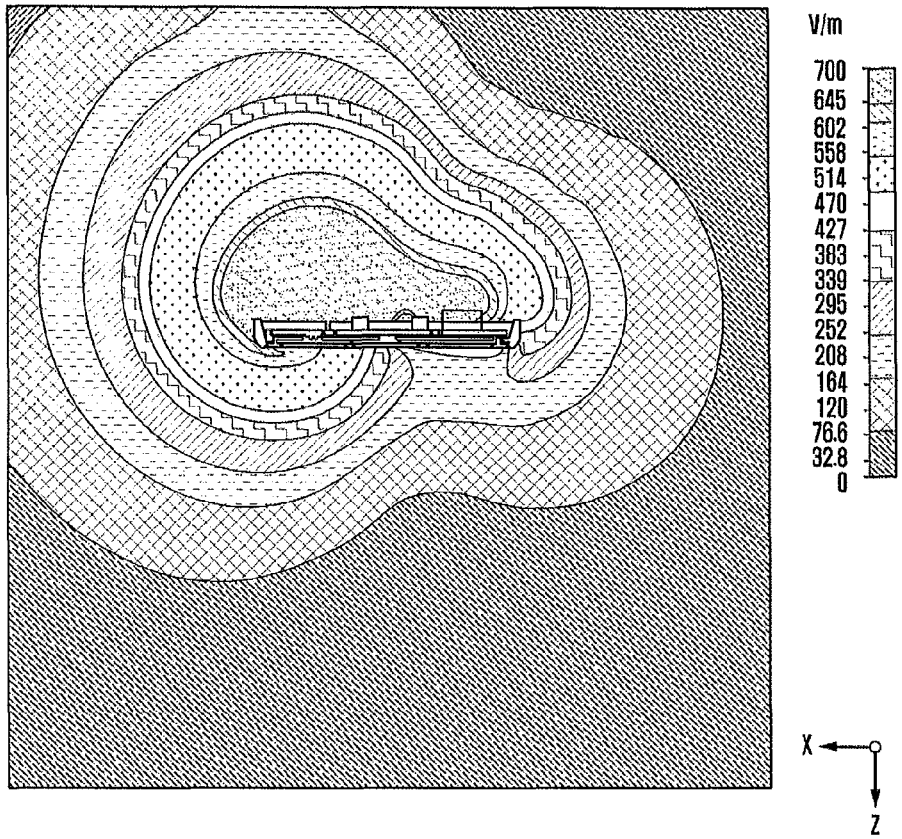
Figure 5C:
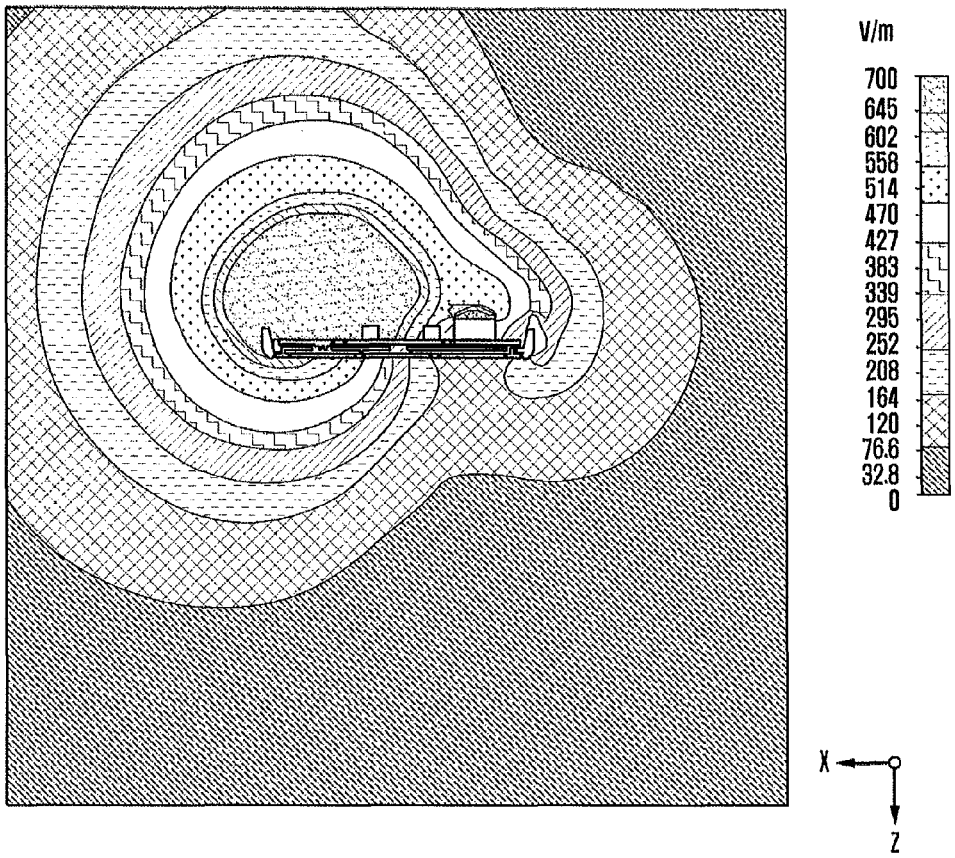
Figure 5D:
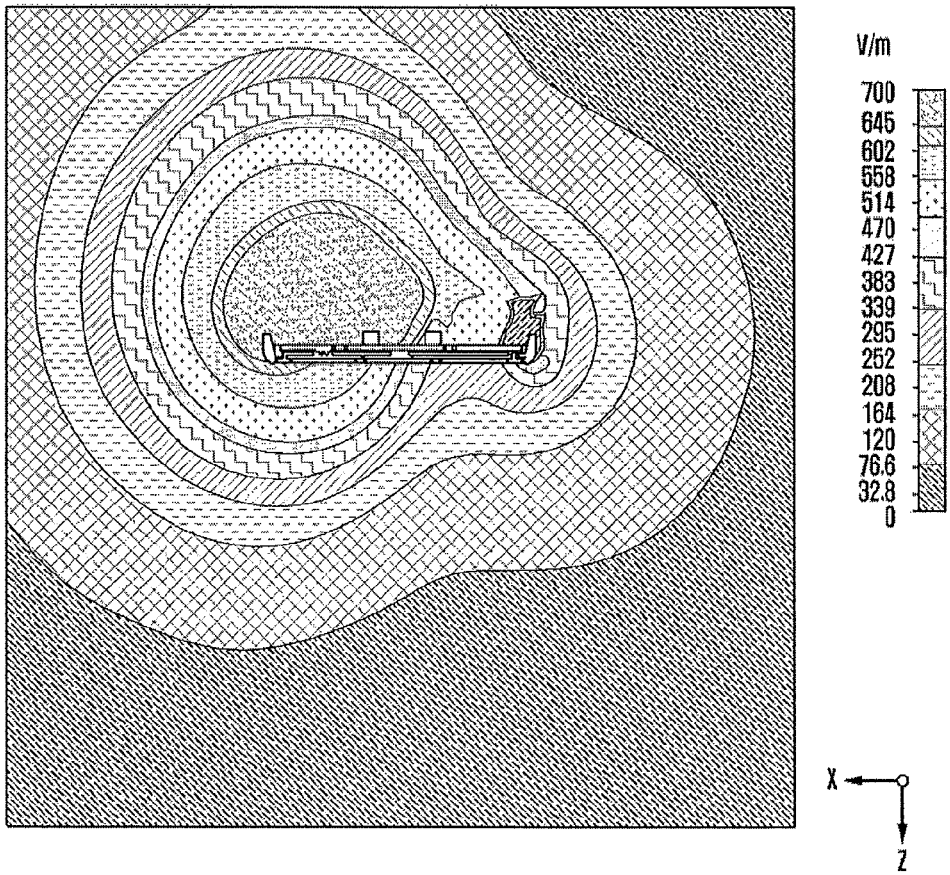

FIGS. 5A through 5D illustrate images of an electric field distribution between ground pads according to a separation distance between ground pads in a MIMO antenna apparatus. FIG. 5A illustrates an embodiment where a separation distance is 13 mm, FIG. 5B illustrates an embodiment where a separation distance is 11 mm, FIG. 5C illustrates an embodiment where a separation distance is 7 mm, and FIG. 5D illustrates an embodiment where a separation distance is 4 mm. Here, the MIMO antenna apparatus has a resonant frequency band of 0.84 GHz.

Referring to FIGS. 5A through 5D, in the MIMO antenna apparatus, when each of antenna devices operates, as a separation distance between the ground pads decreases, an electric field distribution area reduces in a peripheral area of each antenna device in a resonant frequency band. That is, as a separation distance between ground pads decreases to correspond to operation of one of antenna devices in the MIMO antenna apparatus, an electric field distribution area (for example, a red display area) reduces in a peripheral area of a corresponding antenna device. Thereby, in the MIMO antenna apparatus, when each of antenna devices operates, electric field distribution areas of the antenna devices are suppressed from being overlapped. That is, as the ground pads are adjacently disposed in the MIMO antenna apparatus, electromagnetic coupling of the antenna devices is suppressed. Therefore, in the MIMO antenna apparatus according to the present embodiment, an operation characteristic is improved.

Figure 6A:
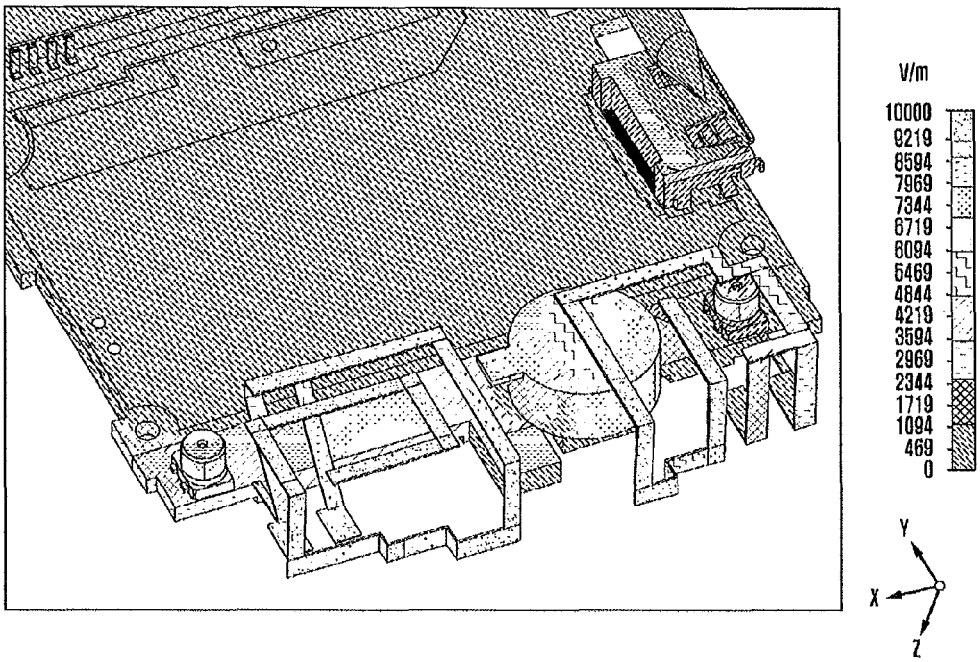
Figure 6B:
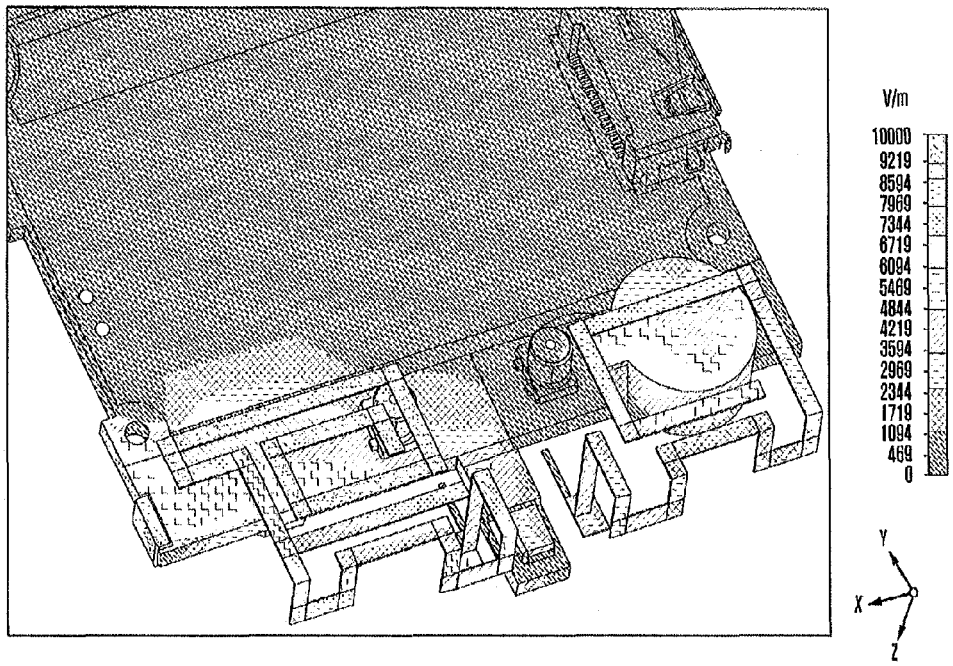

FIGS. 6A and 6B illustrate images of an electric field distribution of antenna devices in a MIMO antenna apparatus. FIG. 6A illustrates an embodiment where a separation distance between ground pads is more than 7 mm in the MIMO antenna apparatus and an extension length of an operation line in each of antenna devices is less than 5 mm. FIG. 6B illustrates an embodiment where a separation distance between ground pads is 7 mm or less in the MIMO antenna apparatus and an extension length of an operation line in each of antenna devices is 5 mm or more.

Referring to FIGS. 6A and 6B, in the MIMO antenna apparatus, when each of the antenna devices operates, as a separation distance between ground pads decreases and an extension length of an operation line in each of the antenna devices increases, an electric field distribution area (for example, a red display area) reduces in a peripheral area of each antenna device. That is, in the MIMO antenna apparatus, as a separation distance between the ground pads decreases and an extension length of the operation line increases to correspond to operation of one of the antenna devices, an electric field distribution area reduces in a peripheral area of a corresponding antenna device. Thereby, in the MIMO antenna apparatus, when each of antenna devices operates, electric field distribution areas of the antenna devices are suppressed from being overlapped. That is, in the MIMO antenna apparatus according to the present embodiment, as electromagnetic coupling of antenna devices is suppressed, an operation characteristic is improved.

In the MIMO antenna apparatus of the foregoing embodiment, an example of a structure in which each pad device is physically coupled to a ground pad and a feeding pad has been described, however the present invention is not limited thereto. That is, even if each pad device is formed in a structure physically separated from aground pad and a feeding pad, the present invention can be embodied. This is described with reference to FIGS. 7 to 9.

Figure 7:
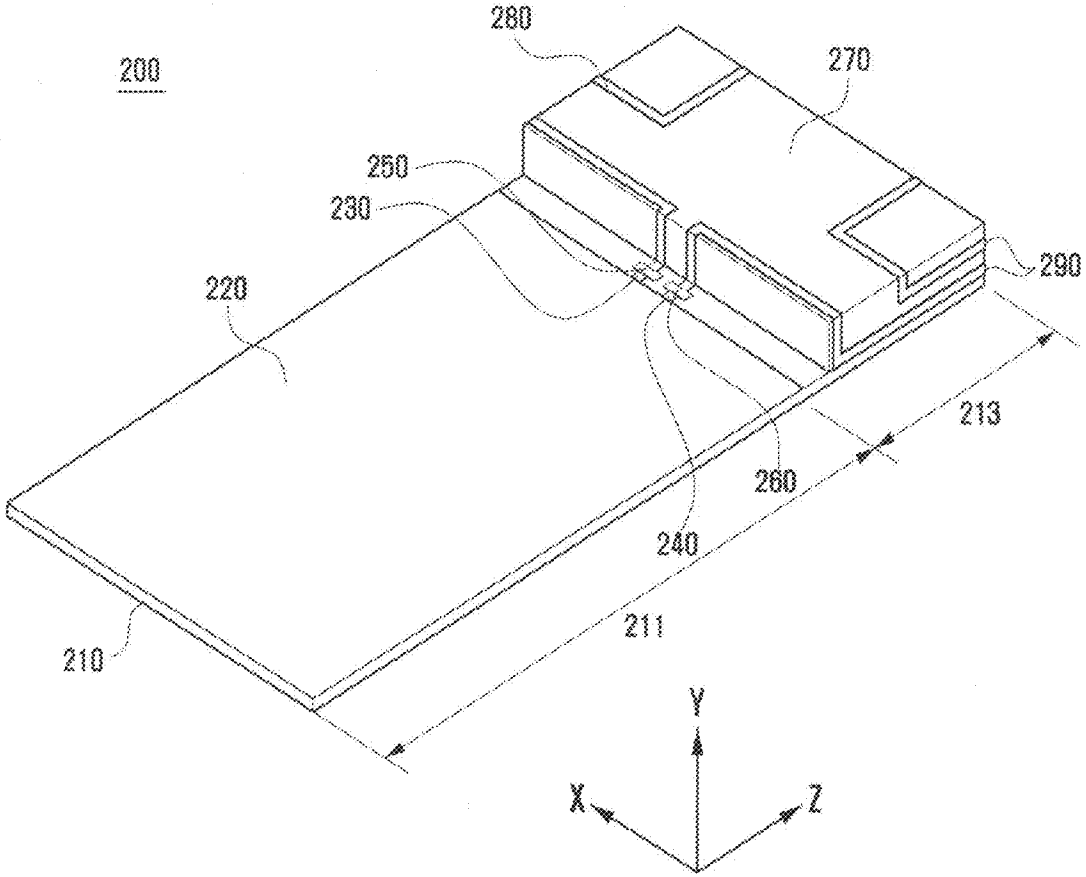
FIG. 7 illustrates in one direction a structure of a MIMO antenna apparatus according to another embodiment of the present invention.
Figure 8:
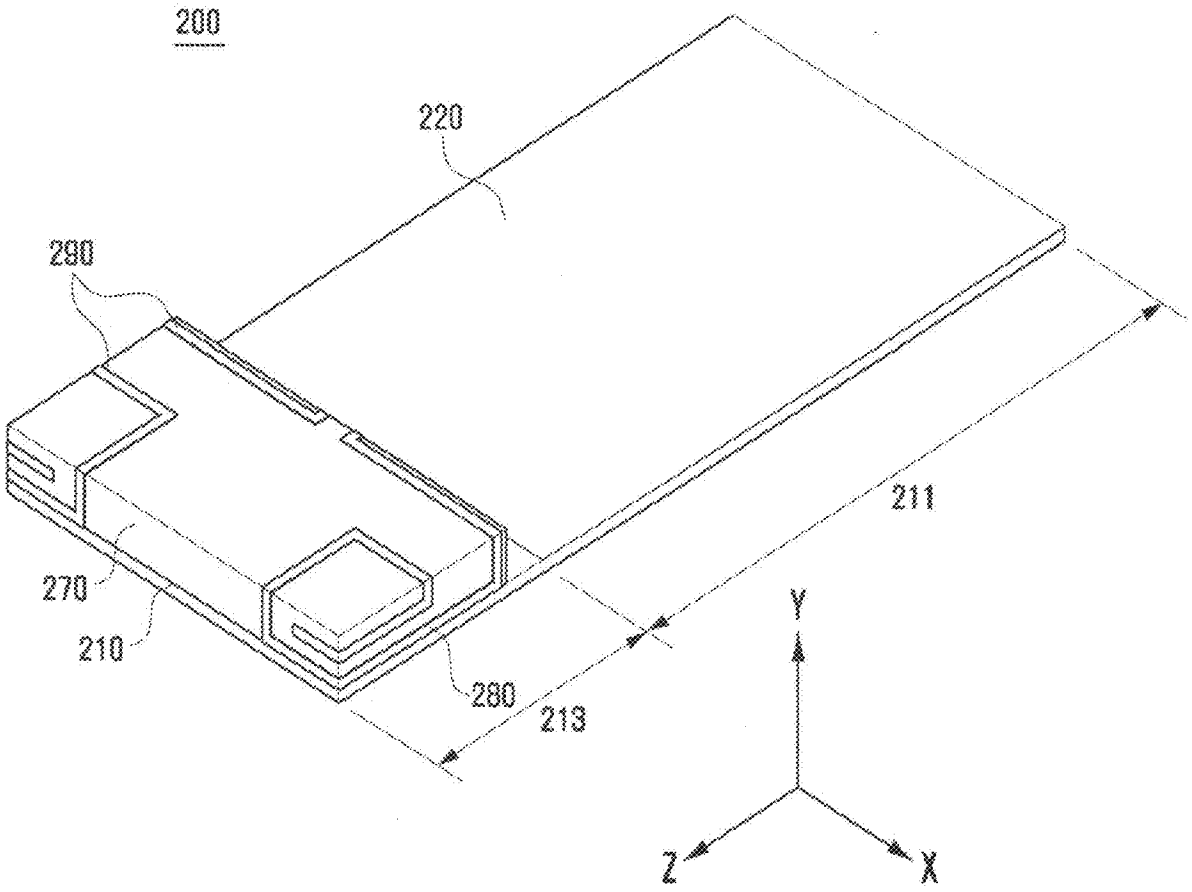
FIG. 8 illustrates in another direction a structure of a MIMO antenna apparatus according to another embodiment of the present invention.
Figure 9:
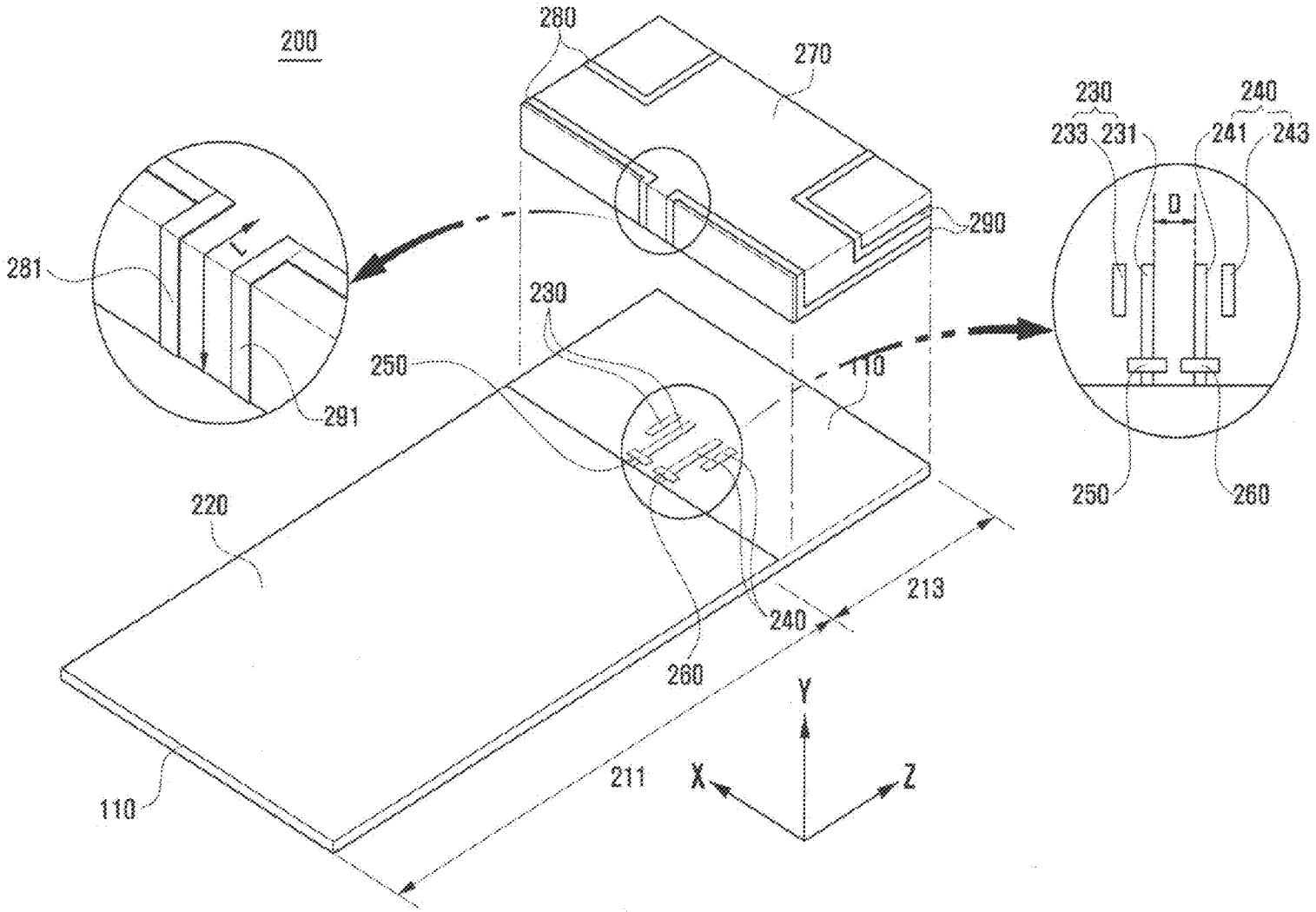
FIG. 9 illustrates a configuration of a MIMO antenna apparatus according to another embodiment of the present invention.

FIG. 7 is a perspective view illustrating in one direction a structure of a MIMO antenna apparatus according to another embodiment of the present invention. FIG. 8 is a perspective view illustrating in another direction the structure of the MIMO antenna apparatus according to the present embodiment of the present invention. FIG. 9 is an exploded perspective view illustrating a configuration of the MIMO antenna apparatus according to the present embodiment of the present invention. In the present embodiment, the MIMO antenna apparatus is formed as a PCB.

Referring to FIGS. 7, 8, and 9, a MIMO antenna apparatus 200 according to the present embodiment includes a main board 210, ground plate 220, pad devices 230 and 240, matching device 250 and 260, antenna carrier 270, and antenna devices 280 and 290. A basis configuration of the MIMO antenna apparatus 200 of the present embodiment is similar to that of the foregoing embodiment and therefore a detailed description thereof is omitted. However, in the pad devices 230 and 240 according to the present embodiment, ground pads 231 and 241 and feeding pads 233 and 243, respectively, are physically separated. The antenna devices 280 and 290 individually contact with the ground pads 231 and 241 and the feeding pads 233 and 243 and are electrically connected to the ground pads 231 and 241 and the feeding pads 233 and 243, respectively.

Each of the ground pads 231 and 241 contacts with the ground plate 220 through one end portion and is disposed at a device area 213 of the main board 210. Each of the ground pads 231 and 241 is extended from the ground plate 220 to the device area 213 through the other end portion, for example in at least one of an X-axis direction and a Z-axis direction. The ground pads 231 and 241 are separated by a predetermined separation distance D. The ground pads 231 and 241 are formed to sustain a gap by the separation distance. Here, the separation distance may be more than 0 mm and less than or equal to 7 mm. Further, each of the ground pads 231 and 241 may be formed in at least one of a bar type, meander type, spiral type, step type, and loop type.

Each of the feeding pads 233 and 243 is electrically connected to a feeding line of the main board 210 through one end portion and is disposed at the device area 213 of the main board 210. Each of the feeding pads 233 and 243 is extended from a feeding line of the main board 210 to the device area 213 through the other end portion, for example in at least one of an X-axis direction and a Z-axis direction. The feeding pads 233 and 243 are disposed adjacent to the ground pads 231 and 241, respectively. The feeding pads 233 and 243 are disposed opposite to the ground pads 231 and 241, respectively. That is, the ground pads 231 and 241 are disposed between the feeding pads 233 and 243. Here, the feeding pads 233 and 243 are extended parallel to the ground pads 231 and 241, respectively. In addition, each of the feeding pads 233 and 243 may be formed in at least one of a bar type, meander type, spiral type, step type, and loop type.

The matching devices 250 and 260 are provided for electrical matching in the MIMO antenna apparatus 200. That is, the matching devices 250 and 260 support electrical matching for the antenna devices 280 and 290, respectively. The matching devices 250 and 260 are separately mounted in the device area 213 of the main board 210. The matching devices 250 and 260 are mounted in a surface of the main board 210 and are disposed at the device area 213. The matching devices 250 and 260 are electrically connected to the ground pads 231 and 241 of the pad devices 230 and 240, respectively. Thereby, the matching devices 250 and 260 are connected to the ground plate 220 through the ground pads 231 and 241, respectively. Further, the matching devices 250 and 260 each have a matching inductance. Here, the matching inductance may be between 2 nH and 7 nH. In addition, the matching devices 250 and 260 are formed with electronic elements and mounted in the ground pads 231 and 241, respectively.

The antenna devices 280 and 290 are connected to the ground plate 220 through the ground pads 231 and 241 of the pad devices 230 and 240, respectively. The antenna devices 280 and 290 are connected to a feeding line of the main board 210 through the feeding pads 233 and 243 of the pad devices 230 and 240, respectively. Further, the antenna devices 280 and 290 are extended from the pad devices 230 and 240 to the device area 213 through the other end portion, for example in at least one of an X-axis direction and a Z-axis direction. In addition, the antenna devices 280 and 290 are formed in a transmission line type of a metal material and are disposed at the device area 213. The antenna devices 280 and 290 are extended parallel by a predetermined extension distance from each one end portion. That is, the antenna devices 280 and 290 are extended parallel from one end portion and include operation lines 281 and 291, respectively, having a predetermined extension length L. Here, an extension length may be between 5 mm and 30 mm.

The antenna devices 280 and 290 may be patterned on a surface of the device area 213 or may be patterned on a surface of the antenna carrier 270. Thereby, the antenna devices 280 and 290 are separately disposed from the main board 210 and the ground plate 220, respectively, by a distance corresponding to a thickness or an area of the antenna carrier 270. Each of the antenna devices 280 and 290 is formed in a structure having at least one bent portion. Here, each of the antenna devices 280 and 290 is formed in at least one of a meander type, spiral type, step type, and loop type.

Thereby, when power is applied from an external power source through the feeding pads 233 and 243 of the pad devices 230 and 240, respectively, the antenna devices 280 and 290 resonate in a resonant frequency band. Here, as power is limitedly applied to a portion of the feeding pads 233 and 243, a portion of the antenna devices 280 and 290 resonates in a resonant frequency band. The antenna devices 280 and 290 are grounded to the ground plate 220 through the ground pads 231 and 241 of the pad devices 230 and 240, respectively. A signal is radiated from each of the antenna devices 280 and 290 to air. Here, a radiation signal of one of the antenna devices 280 and 290 is transmitted into the remaining one of the antenna devices 280 and 290 via air. Further, a radiation signal of one of the antenna devices 280 and 290 is transmitted into the remaining one of the antenna devices 280 and 290 via the ground plate 220 in air.

In the pad devices 230 and 240 for each of the antenna devices 280 and 290, the ground pads 231 and 241 are separately disposed by a predetermined separation distance, and in the antenna devices 280 and 290, the ground pads 231 and 241 are extended parallel by a predetermined extension distance from the pad devices 230 and 240. Thereby, an amplitude of a radiation signal transmitted into air from the antenna devices 280 and 290 and an amplitude of a radiation signal transmitted via the ground plate 220 are identical. The antenna devices 280 and 290 are connected to the matching devices 250 and 260, respectively, each having matching inductance. Thereby, a phase of a radiation signal transmitted into air from the antenna devices 280 and 290 and a phase of a radiation signal transmitted via the ground plate 220 have a difference of a half-wavelength, i.e., 180°.

Accordingly, a radiation signal transmitted into air from the antenna devices 280 and 290 and a radiation signal transmitted via the ground plate 220 are offset. That is, a radiation signal of one of the antenna devices 280 and 290 is suppressed from operating as an interference signal of the remaining one of the antenna devices 280 and 290. Thereby, electromagnetic coupling between the antenna devices 280 and 290 is suppressed.

In the MIMO antenna apparatuses of the foregoing embodiment, two antenna devices are disposed at a main board, however the present invention is not limited thereto. That is, in the MIMO antenna apparatus, even if three or more antenna devices are disposed at a main board, the MIMO antenna apparatus according to the present invention can be embodied. The antenna devices should be electrically connected to each pad device by contacting with each pad device. In the pad devices for each of the antenna devices, the ground devices should be separately disposed by a predetermined separation distance. Here, a separation distance may be more than 0 mm and less than or equal to 7 mm. Further, the antenna devices should be extended parallel by a predetermined extension distance from the pad devices thereof. That is, the antenna devices should be extended parallel from one end portion and have the respective operation lines having a predetermined extension length. Here, an extension length may be between 5 mm and 30 mm. Further, each of the antenna devices should be connected to matching devices having each matching inductance. Here, matching inductance may be between 2 nH and 7 nH.

In MIMO antenna apparatuses of the foregoing embodiment, the antenna devices are formed as a transmission line patterned in a main board or an antenna carrier, however the present invention is not limited thereto. That is, as the antenna device is formed as an electronic element coupled body having intrinsic inductance and capacitance, a MIMO antenna apparatus according to the present invention can be embodied. For example, antenna devices may be formed as an electronic element coupled body.

In the MIMO antenna apparatuses of the foregoing embodiment, each antenna device may be formed as a transmission circuit of a metamaterial structure. A metamaterial may have an electromagnetic structure or be a material synthesized by an artificial method in order to represent a special electromagnetic property that cannot often be observed in the natural world. Such a metamaterial has permittivity and permeability of a negative value under a specific condition and meaning of a character value and represents an electromagnetic wave transmission characteristic different from a general material or an electromagnetic structure. That is, in the present embodiment, a metamaterial structure is a structure using an inversion characteristic of a phase velocity of electromagnetic waves and is formed in a composite right/left handed (CRLH) structure. Here, the CRLH structure is formed in a coupled structure of a right handed (RH) structure representing a general characteristic in which a propagation direction of an electric field, a magnetic field, and electromagnetic waves follows the right-hand rule and a left handed (LH) structure representing a characteristic in which a propagation direction of an electric field, a magnetic field, and electromagnetic waves follows the left-hand rule contrary to the right-hand rule.

According to the present invention, when a MIMO antenna apparatus operates, electromagnetic coupling between antenna devices can be suppressed. Thereby, in the MIMO antenna apparatus, an operation characteristic of antenna devices can be improved. Thereby, an operation performance of the MIMO antenna apparatus can be improved. Further, in the MIMO antenna apparatus, even if antenna devices are adjacently disposed, an operation performance of the antenna devices can be sustained in a predetermined level or more. Accordingly, because a size of the MIMO antenna apparatus can be decreased, a size of a communication terminal for mounting the MIMO antenna apparatus can be decreased.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A MIMO antenna apparatus comprising:

a plurality of antenna devices each comprising an operation line extending parallel by a predetermined extension length from one end portion and configured to operate in a resonant frequency band when power is supplied;

a main board divided into a device area in which the antenna devices are adjacently disposed and a ground area in which a ground plate configured to ground the antenna devices is mounted;

a plurality of ground pads each extending from the ground plate to the device area in the main board, configured to connect the one end portion of each of the antenna devices to the ground plate, and separated by a predetermined distance; and a plurality of feeding pads configured to connect each of the antenna devices to the main board by electrically connecting to the main board and to provide power to each of the antenna devices, wherein at least one of the extension length and the separation distance is determined to make an amplitude of a signal transmitted into air from the antenna devices and an amplitude of a signal transmitted via the ground plate to be equal when the antenna devices operate.

2. The MIMO antenna apparatus of claim 1, further comprising matching devices mounted between the antenna devices and the ground plate in the device area to be connected to the ground pad and having matching inductance such that a phase of a signal transmitted into the air from the antenna devices and a phase of a signal transmitted via the ground plate comprise a difference of a half-wavelength when the antenna devices operate.

3. The MIMO antenna apparatus of claim 2, wherein the matching inductance is between 2 nH and 7 nH.

4. The MIMO antenna apparatus of claim 1, wherein the ground pads and the feeding pads are coupled to correspond to each of the antenna devices to be connected to each of the antenna devices.

5. The MIMO antenna apparatus of claim 1, further comprising an antenna carrier mounted in the device area and configured to mount at least one of the antenna devices, the ground pads, or the feeding pads.

6. The MIMO antenna apparatus of claim 5, wherein the ground pads and the feeding pads are interposed between the device area and the antenna carrier.

7. The MIMO antenna apparatus of claim 1, wherein the separation distance is more than 0 mm and less than or equal to 7 mm.

8. The MIMO antenna apparatus of claim 1, wherein the extension length is between 5 mm and 30 mm.

9. The MIMO antenna apparatus of claim 1, wherein the antenna devices comprise a transmission line having a plurality of bent portions, wherein the antenna devices are formed in at least one of a meander type, a spiral type, a step type, or a loop type.

10. The MIMO antenna apparatus of claim 1, further comprising an antenna carrier mounted in the device of the main board.

11. A wireless terminal, comprising:

an antenna apparatus configured to transmit and receive a plurality of signals, the antenna apparatus comprising:

a plurality of antenna devices each comprising an operation line extending parallel by a predetermined extension length from one end portion and configured to operate in a resonant frequency band when power is supplied;

a main board divided into a device area in which the antenna devices are adjacently disposed and a ground area in which a ground plate configured to ground the antenna devices is mounted;

a plurality of ground pads each extending from the ground plate to the device area in the main board, configured to connect the one end portion of each of the antenna devices to the ground plate, and separated by a predetermined distance; and a plurality of feeding pads configured to connect each of the antenna devices to the main board by electrically connecting to the main board and to provide power to each of the antenna devices, wherein at least one of the extension length and the separation distance is determined to make an amplitude of a signal transmitted into air from the antenna devices and an amplitude of a signal transmitted via the ground plate to be equal when the antenna devices operate.

12. The wireless terminal of claim 11, further comprising matching devices mounted between the antenna devices and the ground plate in the device area to be connected to the ground pad and having matching inductance such that a phase of a signal transmitted into the air from the antenna devices and a phase of a signal transmitted via the ground plate comprise a difference of a half-wavelength when the antenna devices operate.

13. The wireless terminal of claim 12, wherein the matching inductance is between 2 nH and 7 nH.

14. The wireless terminal of claim 12, further comprising an antenna carrier mounted in the device of the main board.

15. The wireless terminal of claim 11, wherein the ground pads and the feeding pads are coupled to correspond to each of the antenna devices to be connected to each of the antenna devices.

16. The wireless terminal of claim 11, further comprising an antenna carrier mounted in the device area and configured to mount at least one of the antenna devices, the ground pads, or the feeding pads.

17. The wireless terminal of claim 16, wherein the ground pads and the feeding pads are interposed between the device area and the antenna carrier.

18. The wireless terminal of claim 11, wherein the separation distance is more than 0 mm and less than or equal to 7 mm.

19. The wireless terminal of claim 11, wherein the extension length is between 5 mm and 30 mm.

20. The wireless terminal of claim 11, wherein the antenna devices comprise a transmission line having a plurality of bent portions, wherein the antenna devices are formed in at least one of a meander type, a spiral type, a step type, or a loop type.

* * * * *